US005700143A

United States Patent [19]

Irwin et al.

[11] Patent Number: 5,700,143

[45] Date of Patent: Dec. 23, 1997

[54] COMBINATION BURNER WITH PRIMARY AND SECONDARY FUEL INJECTION

[75] Inventors: Bruce C. Irwin, Palmyra; Edward E. Moore, Hummelstown; Raymond F. Baum, Lebanon, all of Pa.

[73] Assignee: Hauck Manufacturing Company, Lebanon, Pa.

[21] Appl. No.: 439,944

[22] Filed: May 12, 1995

Related U.S. Application Data

[63] Continuation-in-part of Ser. No. 188,406, Jan. 24, 1994, Pat. No. 5,511,970.

[51] Int. Cl.[6] ..... F23D 17/00

[52] U.S. Cl. ..... 431/284; 431/285; 431/8; 431/182; 431/187; 431/188

[58] Field of Search ..... 431/8, 9, 10, 285, 431/284, 283, 278, 181, 182, 187, 188, 183, 184

[56] References Cited

U.S. PATENT DOCUMENTS

| | | | |
|---|---|---|---|
| 2,979,899 | 4/1961 | Salmon et al. | 60/749 |
| 4,047,877 | 9/1977 | Flanagan | 431/8 |
| 4,701,124 | 10/1987 | Maghon et al. | 431/284 |
| 5,251,447 | 10/1993 | Joshi et al. | 60/737 |
| 5,259,755 | 11/1993 | Irwin et al. | 431/9 |
| 5,451,160 | 9/1995 | Becker | 431/8 |
| 5,511,970 | 4/1996 | Irwun et al. | 431/9 |

*Primary Examiner*—Carl D. Price

*Attorney, Agent, or Firm*—Evenson, McKeown, Edwards & Lenahan, P.L.L.C.

[57] ABSTRACT

A combination burner which uses primary and secondary fuel injection and improves liquid propane combustion. The burner supplies primary air, while secondary air is swirled to shape and mix the flame when the burner is firing "on oil". When the burner is firing "on gas", primary air enters the burner through an annulus at the atomizing air pipe or conduit so as to have the primary gas enter that pipe; secondary gas is injected radially into the air stream at a downstream location relative to an atomizing nozzle. In using liquid propane (butane) to fire the burner, two stage fuel injection is used, with a stream of fuel being injected upstream and toward the burner centerline and another stream of fuel being injected downstream and outwardly away from the burner centerline.

9 Claims, 5 Drawing Sheets

COMBINATION BURNER WITH PRIMARY AND SECONDARY FUEL INJECTION

CROSS-REFERENCE TO RELATED APPLICATIONS

This application is a continuation-in-part of application Ser. No. 08/188,406 filed Jan. 24, 1994, for "COMBINATION BURNER WITH PRIMARY AND SECONDARY FUEL INJECTION" in the name of Bruce C. Irwin, Edward E. Moore and Raymond F. Baum now U.S. Pat. No. 5,511,970, issued Apr. 30, 1996.

BACKGROUND AND SUMMARY OF THE INVENTION

The present invention relates to an improvement in the burner described in the above-identified application, the disclosure of which is hereby incorporated by reference herein. More particularly, the present invention relates to a combination burner of the type generally described in U.S. Pat. No. 5,259,755 but in which secondary air is swirled to improve the oil flame shape, primary gas enters through an annulus defined by the atomizing air pipe, and liquid propane (or butane) has two-stage fuel injection, whereby increased mixing speed is achieved along with improved liquid propane combustion without requiring cooling air for the primary gas manifold.

The above-identified application describes the shortcomings of conventional burners, which shortcomings have been largely overcome by our prior invention. However, we have found that some other problems had to be addressed at least for certain situations where one or more of such problems might be deemed relatively important.

It is therefore an object of the present invention to improve liquid propane (butane) combustion.

A further object of the present invention is to eliminate the requirement for cooling air for the primary gas manifold when operating on liquid propane (butane).

A still further object is to increase mixing speed and produce a shorter flame on oil firing.

The foregoing objects have been achieved in accordance with the present invention by providing a combination burner which supplies primary air in the same manner as described in the above-identified related application. To shape and mix the oil flame, secondary air is swirled and exits past the atomizing air nozzle. Primary gas enters the burner through an annulus at the atomizing air pipe so as to have the primary gas enter the secondary air pipe. Secondary gas is injected radially into the air stream as in our prior burner. However, liquid propane (butane) has two-stage fuel injection in that fuel is injected into the burner at two locations. Although firing "on oil" is still accomplished with the atomizing air and oil nozzle, swirling secondary air aids both in air atomization and oil spray mixing with the air. A cone periphery air flow is utilized to cool the flame retention core and the secondary gas manifold, while maintaining a positive pressure to prevent fuel or flame leakage out of the tertiary air tube.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF TEE DRAWINGS

Figure 1:
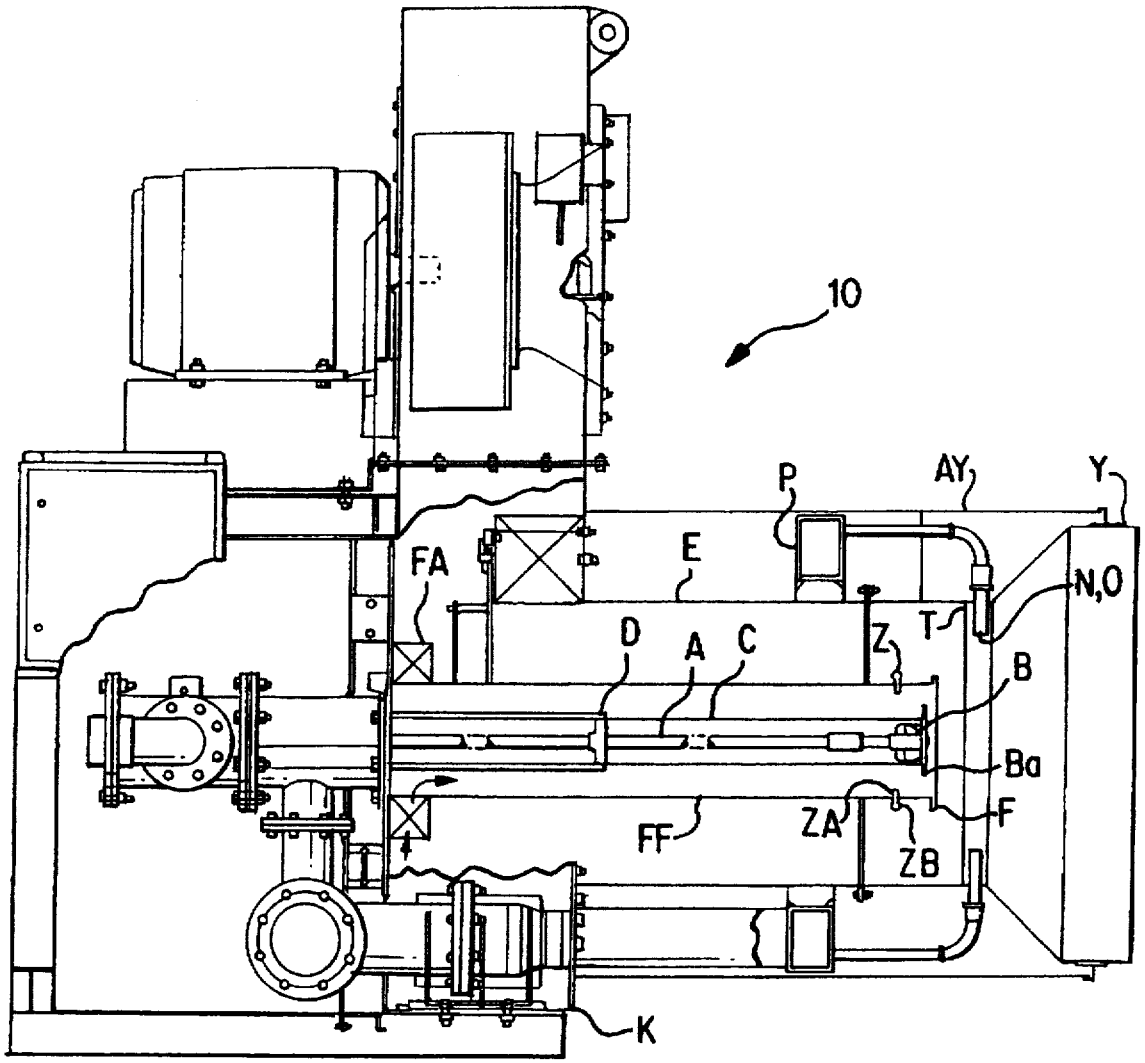
FIG. 1 is a partially cut-away side view of the combination burner according to the present invention.

Referring now to the drawings and, in particular, to FIG. 1, there is shown a combination burner designated generally by the numeral 10 and having the same general basic features as the burner shown in our copending application Ser. No. 08/188,406, said U.S. Pat. No. 5,511,970. That is, this burner 10 shares certain common features with our earlier burner described in the above-identified related application such as the oil tube A which supplies oil to a nozzle B when the burner is firing "on oil" and a primary (or atomizing) air tube C which supplies the primary air when the burner is firing "on oil" or "on gas". Likewise, other standard burner features such as the primary air inlet, the primary gas inlet, the impeller and its associated motor, the variable damper and the pre-swirl inlet are shown schematically in FIG. 1 but are not referenced by letters or numerals because their functions are well known and understood.

Figure 2:
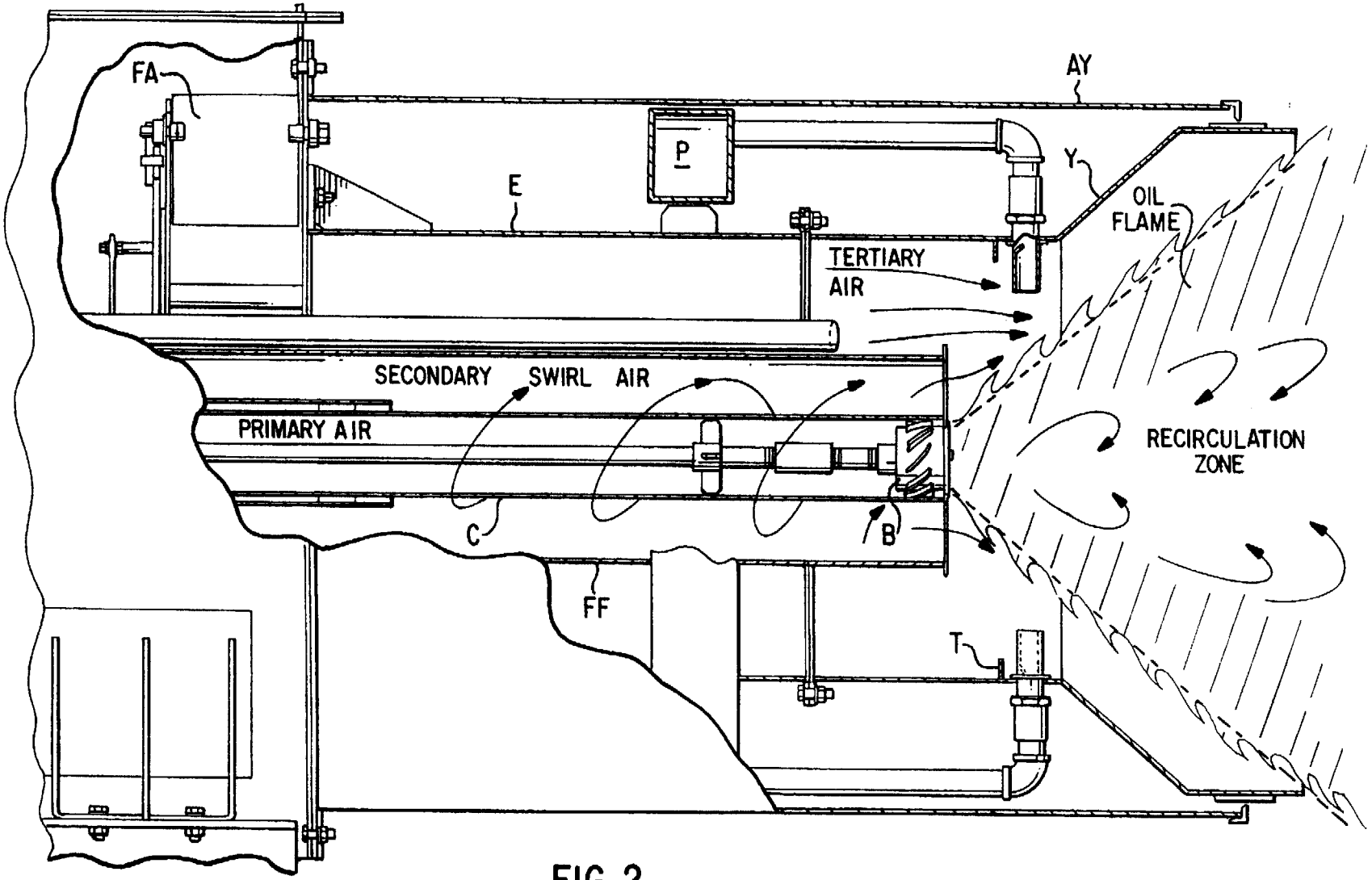
FIG. 2 is an enlarged partial cross-sectional view of the end of the burner shown in FIG. 1 and showing the air flow, flame and recirculation zone patterns when the burner is firing "on oil"

When the burner is firing "on oil" as shown in FIG. 2, secondary air enters through spin vanes FA into the secondary air tube FF where it exits past the conventional atomizing air nozzle (schematically shown) at the end of the primary air tube C, which end is at, or slightly upstream of and therefore in the secondary air tube FF, to give the appropriate angle to the developing oil spray. That is, the essential point is that the primary air tube end is positioned so that the spray will not impinge on the secondary air tube FF or on a secondary gas baffle T described below. The swirling secondary air assists in atomizing the oil spray and in mixing the oil and air. An atomizing ring baffle Ba can optionally be provided at the end of the secondary air tube FF as seen in FIG. 1 to increase flame recirculation in front of (i.e. downstream of) the atomization/oil nozzle B to increase fuel/air stability in this area. This is particularly true when the burner is fired "on gas".

The secondary air supplied is between about 10–35% of the total volumetric gas flow, usually preferably about 15% for "on oil", whereas the primary air is between about 4–10% of the total volumetric gas flow. Due to the secondary air flow, flame retention methods are usable for firing "on gas" and "on propane" which do not require the primary gas section which was extended to the atomizer in our earlier burner incorporated by reference above.

Figure 3:
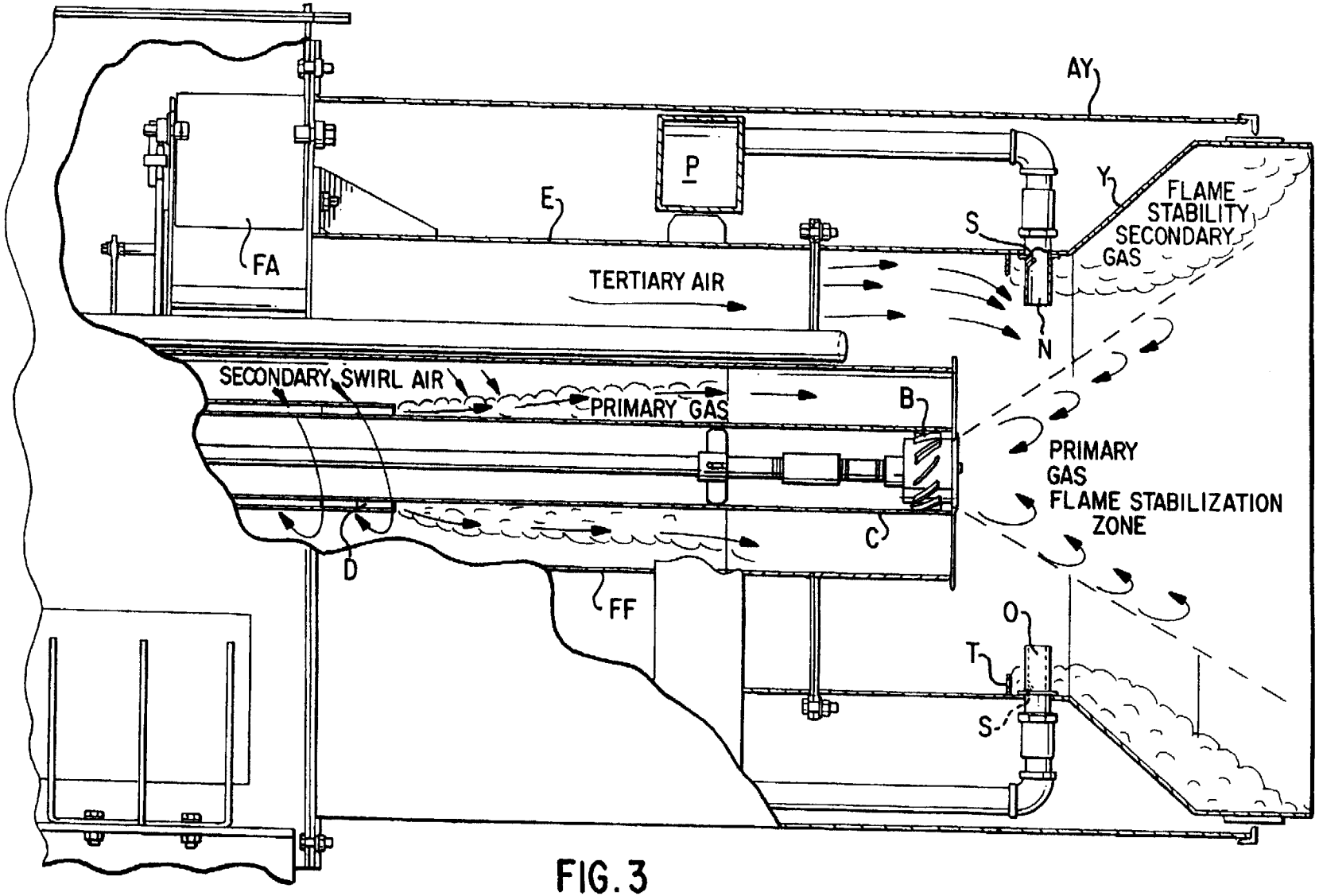
FIG. 3 is a view similar to FIG. 2 but showing the patterns when the burner is firing "on gas"
Figure 4:
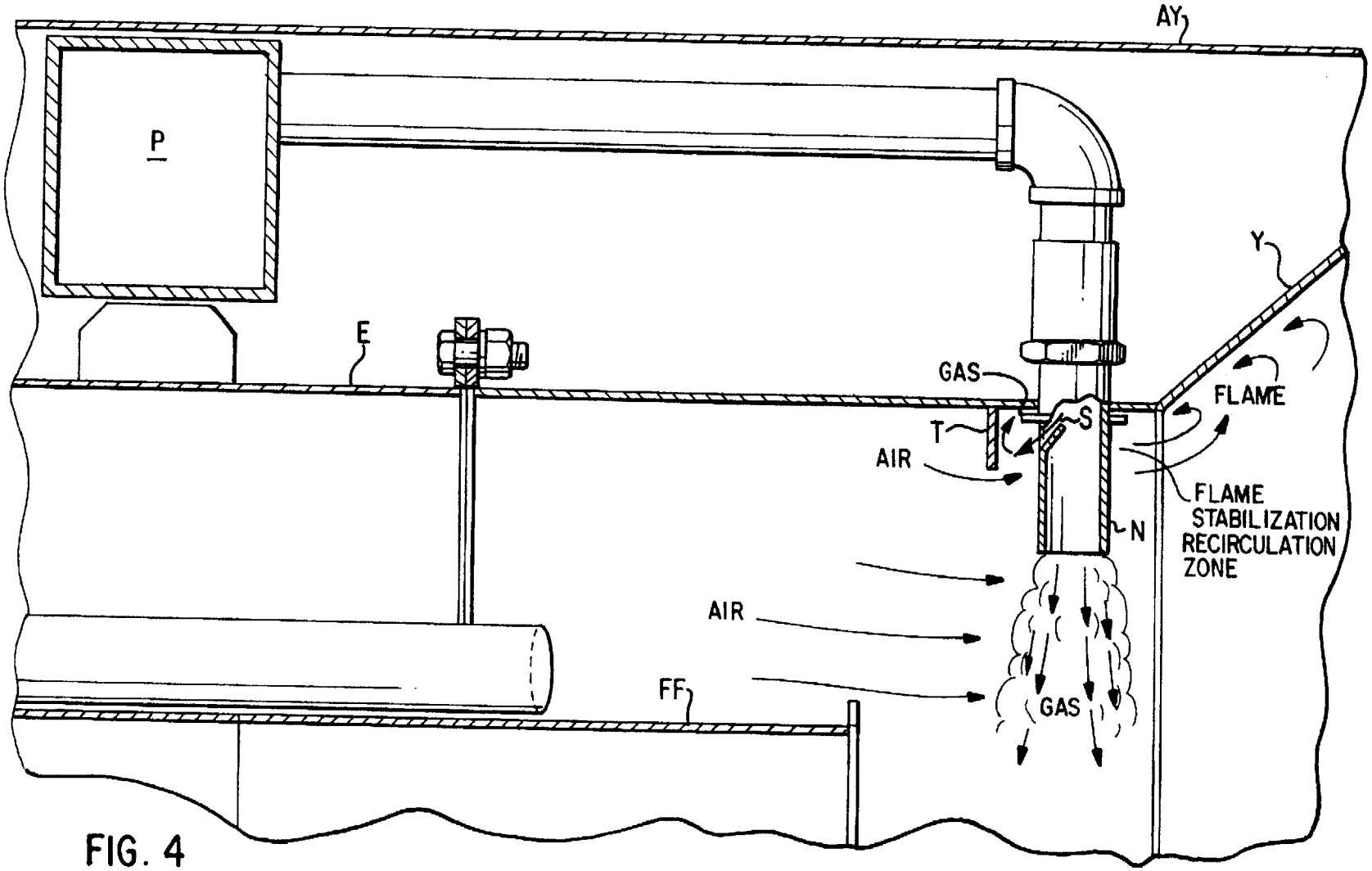
FIG. 4 is an enlarged cross-sectional view of the burner firing "on gas" as seen in FIG. 3 but with secondary gas recirculation.

For firing "on gas" as seen in FIG. 3, the primary gas, which constitutes about 10 to 30% of the total volumetric gas flow, now enters at D through the annulus defined by an outer surface of the primary air tube C. This arrangement has been found to be a particularly effective way of introducing the primary gas into the secondary air tube FF where it is premixed into the swirling secondary air flow. The fuel/air ratio in the secondary air tube FF can vary from stoichiometric to excess air. That ratio must be adjusted for each burner size to maintain a stable flame in the flame recirculation zone in front of the air atomization/oil nozzle B at higher firing rates. As in our earlier burner, secondary gas is injected radially into the burner from nozzles N and O as seen in FIG. 4 which shows only the nozzle N. A secondary gas baffle ring T is, however, arranged at the nozzles N, O which are also provided with scoops S to discharge a desired amount of baffle flame retention gas into an area downstream of the secondary gas baffle ring T as shown by the circulation patterns in FIG. 4.

Figure 5:
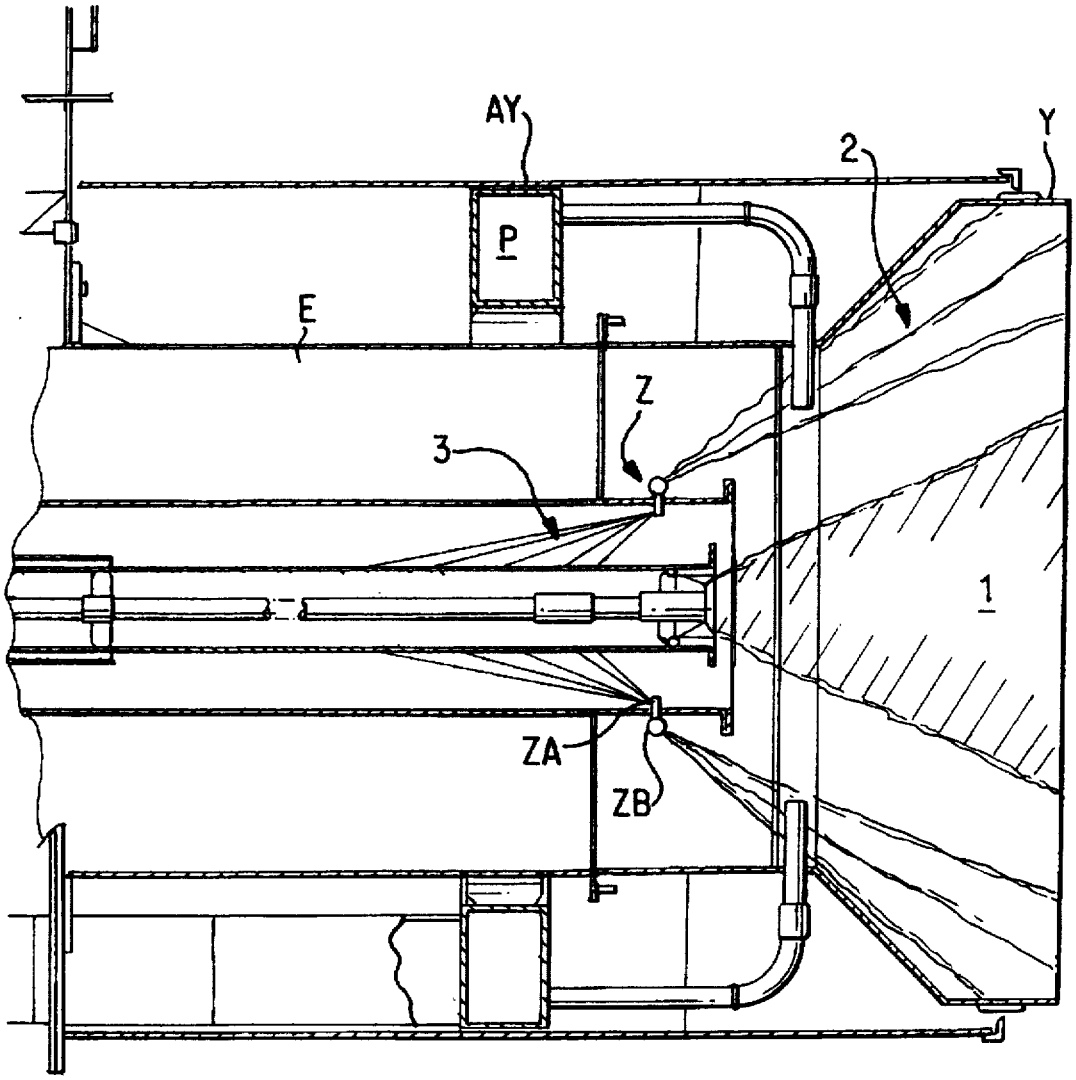
FIG. 5 is a partial, slightly enlarged view of the downstream end or exit of the burner shown in FIG. 1 schematically illustrating the flame recirculation area in front of the atomizing air nozzle, the area of secondary fuel injection, and the area of primary fuel injection into the secondary air tube when the burner is on "propane".

For burning "on propane" as seen in FIG. 5, propane (butane) fuel is injected in two stages from an injector device Z comprising injectors ZA and ZB. Injector ZA is directed radially inwardly of the secondary air tube FF to inject fuel in an upstream direction which conveys toward the burner center. Injector ZB is directed radially outwardly on the secondary air tube FF to inject the liquid propane (butane) fuel in a downstream direction which diverges from the burner center. The injector ZA injects about 15 to 30% of the total liquid propane flow upstream in the secondary air tube FF, i.e. counter to the secondary air flow, to cause a swirling premix of propane/air and burning of the premix upstream of injector ZA at all listed firing rates. This premix preheats and vaporizes the propane in the flame retention area constituted by the recirculation zone in front of the air atomizer/oil nozzle B. The remainder of the propane flow, about 70 to 85%, for firing, is injected into a tertiary air chamber tube E providing the main combustion air at an angle of about 30% relative to the horizontal centerline of the burner to mix with the intersecting tertiary air flow which has passed through swirl vanes G to determine the flame shape. These nozzles ZB can also be arranged to generate swirl by the use of a compound angle.

FIG. 5 also illustrates the injection zones and flame development areas when the burner is fired "on propane". Specifically, the cone-like area (actually a volume) designated by numeral 1 represents the flame recirculation area in front (downstream) of the atomizing air/oil nozzle B, the area 2 represent the areas of secondary fuel injection for propane injector ZA, and area 3 represents the primary fuel injection from the injector ZA counter to the secondary air flow in the secondary air tube FF.

Finally, cone periphery air flow in an amount between about 10 to 30%, preferably 15%, of total air flow through the cone periphery tube AY cools the flame retention cone Y and the secondary gas manifold P. This cone periphery air flow maintains a positive pressure at the exit of the cone Y and thereby prevents flames or fuel from leaking out of the tube E where the secondary gas nozzles N, O enter from the cone periphery tube AY. The cone periphery air flow also mixes with the already well developed flame and entrains flue gas in the final fuel/air/flue gas mixture constituting the developing flame. Moreover, this air flow retard dusts from entering the base of the flame where flame quenching could occur with resulting stability problems, a matter of particular importance in a dusty environment.

With the tertiary air flow, the secondary gas manifold P has less of a tendency to experience thermal differential problems such as cracks and the like. The same is true with regard to the flame retention cone Y. The two-stage propane injection scheme improves the combustion process without any need for supplying cooling air for the primary gas manifold. The use of secondary air "on oil" results in increased mixing speeds and shorter flames.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A combination burner, comprising a primary air supply conduit having a central axis;

an atomizing nozzle operatively arranged inside the primary air supply conduit;

a secondary swirl air supply conduit arranged to permit secondary swirl air to exit past the atomizing nozzle and to shape a flame;

an annulus defined, in part, by the primary air supply conduit for selectively injecting primary gas into the secondary swirl air conduit when the burner is in a gas firing state;

a tertiary air supply conduit surrounding and partially defined by the secondary swirl air conduit for providing swirling tertiary air flow;

means for selectively supplying oil to the atomizing nozzle when the burner is in an oil firing state;

secondary gas supply nozzles for injecting secondary gas radially inwardly toward a centerline of the burner in the gas firing state to form a secondary gas flame stability zone;

injectors arranged selectively in relation to the secondary swirl air supply conduit to inject two streams of fuel, the first of the two streams converging toward the central axis of the primary air supply conduit as viewed in an upstream direction in the secondary swirl air conduit and the second of two streams diverging away from the central axis in a downstream direction in the secondary swirl air conduit with the burner in a firing state for firing the two streams of fuel;

and means for selectively swirling the second of the two streams.

2. The burner according to claim 1, wherein the tertiary air supply conduit is provided with a baffle ring operatively arranged in relation to the secondary gas supply nozzles to create a recirculation zone downstream of the baffle ring.

3. The burner according to claim 2, wherein the secondary gas supply nozzles have a scoop-like aperture facing generally towards the baffle ring to supply a portion of the secondary gas flowing through the nozzles.

4. In a combination burner having a primary air supply, a primary air tube through which primary air flows from the primary air supply, a secondary air supply, means for swirling secondary air from the secondary air supply, a secondary air tube surrounding the primary air tube such that the swirled secondary air flows in the secondary air tube, a primary gas supply arranged to provide a primary gas to the swirled secondary air, a secondary gas supply arranged to supply a secondary gas downstream of the primary air tube, and means for supplying atomized oil in a direction downstream of the primary and secondary air tubes when the burner is preselected fire on oil instead of on the primary and secondary gas, the improvement comprising a wall spaced radially outwardly from the primary air tube to define an annulus through which the primary gas flows, said primary gas being introduced at a radially inner portion of the swirled secondary air tube.

5. In the combination burner according to claim 4, wherein the secondary gas supply comprises injectors arranged to inject the secondary gas radially into the burner toward a central axis of the primary air tube and in a zone of tertiary air supply.

6. The combination burner according to claim 5, wherein a baffle ring is located upstream of the injectors to form a recirculation zone, and the injectors are provided with secondary exits for injecting a portion of the secondary gas into the recirculation zone in a manner which promotes flame stability.

7. The combination burner according to claim 6, wherein the secondary exits are scoop-like apertures formed in a wall of the nozzles to inject the secondary gas obliquely into the recirculation zone opposite tertiary air flow.

8. In a combination burner having a primary air supply, a primary air tube having a central axis and through which primary air flows from the primary air supply, a secondary air supply, means for swirling secondary air from the secondary air supply, a secondary air tube surrounding the primary air tube such that the swirled secondary air flows in the secondary air tube, a primary gas supply arranged to provide a primary gas to the swirled secondary air, and a tertiary air supply located radially outwardly of the secondary air tube, a secondary gas supply arranged to supply a secondary gas downstream of the primary air tube, the improvement comprising a first set of injectors arranged at the secondary air tube through which swirling secondary air is flowing to direct liquid fuel in a substantially upstream direction of the secondary air tube opposite to flow of the swirling secondary air and toward the central axis, a second set of injectors arranged at the secondary air tube to direct liquid fuel in a substantially downstream direction of the secondary air tube and diverging away from the central axis into tertiary air from the tertiary air supply, and means for selectively inducing swirl in the liquid fuel from the second set of injectors.

9. A burner firing method, comprising the steps of (a) flowing primary air along an axial direction of a burner;

(b) flowing secondary swirl air along the axial direction for shaping a burner flame;

(c) flowing primary gas radially inwardly of the secondary swirl air relative to a central axis of the primary air flow and upstream of the burner flame, when the burner is in a gas firing state;

(d) flowing tertiary air radially outwardly of the secondary swirl air relative to the central axis of the primary air flow;

(e) flowing a relatively large amount of secondary gas toward the central axis through a nozzle in a primary gas stabilization zone in the gas firing state;

(f) supplying a relatively small amount of the secondary gas in an upstream direction of the burner to create a recirculation zone in a region of the nozzle in the gas firing state;

(g) supplying oil through an oil atomizer when the burner is in an oil firing state; and (h) supplying one of propane and butane in the upstream direction into the secondary swirl air and in a direction converging toward the central axis, and further supplying propane or butane in a downstream direction of the burner and in a direction diverging away from the central axis when the burner is in one of a propane and butane firing state.

* * * * *